United States Patent [19]

Patzke et al.

[11] 4,082,206

[45] Apr. 4, 1978

[54] CAP ASSEMBLY FOR AQUEOUS AMMONIA CONTAINER

[75] Inventors: Robert C. Patzke, Prospect Heights; Thomas V. DeRyke, Libertyville; Frederick D. Meller, Lombard, all of Ill.

[73] Assignee: Addressograph Multigraph Corporation, Cleveland, Ohio

[21] Appl. No.: 708,054

[22] Filed: Jul. 23, 1976

[51] Int. Cl.[2] ..... B65D 83/00

[52] U.S. Cl. ..... 222/400.7; 137/323; 222/483

[58] Field of Search ..... 222/400.7, 400.8, 483; 354/300; 138/45; 137/323; 215/309, 311, 313, 207, 216, 219; 221/86

[56] References Cited

U.S. PATENT DOCUMENTS

| | | | |
|---|---|---|---|
| 3,035,603 | 5/1962 | Jamieson et al. | 222/400.7 X |
| 3,437,236 | 4/1969 | Huck | 221/86 X |
| 3,498,313 | 3/1970 | Belich | 222/400.7 X |
| 3,535,997 | 10/1970 | Blake | 354/300 X |
| 3,855,997 | 12/1974 | Sauer | 215/309 X |
| 3,984,021 | 10/1976 | Uhlig | 215/216 |

*Primary Examiner*—Robert B. Reeves

*Assistant Examiner*—Fred A. Silverberg

*Attorney, Agent, or Firm*—Michael A. Kondzella

[57] ABSTRACT

A cap assembly is provided for use with a container for storing and supplying aqueous ammonia to a diazo type copying machine. The cap assembly comprises a closure member mounted on the container and a key device associated with free ends of an ammonia feed tube and a drain tube connecting the container to a developer system of the copying machine. The closure member includes a feed outlet to permit ammonia flow from the container to the feed tube and a drain outlet to permit ammonia flow from the drain tube to the container. The closure member also includes a seal adapted for selective actuation by the key device between a first position for closing the feed and the drain outlets to prevent ammonia flow and a second position for opening the outlets to permit ammonia flow. The key device is releasably retained by the closure member when the seal is in the second position and is released from the closure member when the seal is in the first position, to thereby prevent escape of ammonia fumes from the container to the ambient atmosphere during replacement of an empty container with a container providing a fresh supply of ammonia.

9 Claims, 6 Drawing Figures

CAP ASSEMBLY FOR AQUEOUS AMMONIA CONTAINER

BACKGROUND OF THE INVENTION

Ammonia type diazo machines for the preparation of copies of translucent originals are well known in the art. In general, such machines are provided with a printer section where a high intensity light exposes sensitized material through an original document to be copied. A separator section then separates the original from the sensitized material and transports the sensitized material to a developer system. In the developer system, the exposed sensitized material is processed or developed by exposure to vapor of a volatile developing agent or ammonia gas. The developed copy is then transported from the developer section and provides a high quality permanent copy of the original document.

To supply the developer system with ammonia fumes for developing the copy, it is conventional practice to pump the ammonia from a shipping container to the developing system. In some instances, the unused ammonia is recirculated to the container to avoid escape of ammonia fumes to the atmosphere. One such arrangement is shown in U.S. Pat. No. 3,535,997. As shown therein, the device comprises a developer tray, a container of ammonia developer, a pump and two ducts. The first duct conveys the ammonia from the container to the tray and the pump circulates the ammonia vapor into the tray and, via the second duct, to the container.

While such an arrangement might reduce escape of ammonia fumes to the atmosphere during operation of the machine, it does not provide for preventing escape of ammonia fumes from the container during the interchange of an empty container with a container providing a fresh supply of ammonia. Hence, and as shown in the reference patent, in the course of interchanging the containers it is necessary to remove a plug from the empty container, remove a cap from the full container and to substitute the plug for the cap of the container providing the fresh supply of ammonia. In so doing, of course, the ammonia fumes and vapor from both the empty container and the full container are discharged to the ambient atmosphere until such time as the empty container is capped and the full container is provided with the plug for blocking the neck of the container. Because the device does not prevent the escape of ammonia fumes during the interchange of the containers, the room in which the machine is installed becomes fouled with objectionable ammonia odor.

SUMMARY OF THE INVENTION

The present invention provides a cap assembly for an ammonia container to permit interchange or replacement of one container with another without exposing the ammonia fumes in the containers to the atmosphere. The cap assembly includes a closure member releasably mounted on a neck of the container and a key means connected to the free ends of an ammonia feed tube and a drain tube extending from the container to a developer system of the copying machine. The closure member is provided with a feed outlet to permit ammonia flow from the container to the developer system via a pump metering system and feed tube, and a drain outlet is provided to permit ammonia flow from a pump overflow system to the container via the drain tube. A seal means is rotatably supported by the closure member and is adapted to be selectively actuated by the key means between a first position for closing the feed and the drain outlets and a second position for opening the outlets to thereby prevent or permit ammonia flow, respectively.

The key means, attached to the free ends of the feed and the drain tubes, is removably engagable with the seal means and is releasably retained by the closure member when the seal means is actuated to the second position. In response to the seal means being actuated to the first position, the key means is released from the closure member in readiness for actuating the seal means, associated with a container providing a fresh supply of ammonia, from the closed to the open position. In this way, because the outlets of the seal means are closed on the empty container prior to removal of the key means therefrom, and because the outlets on the seal means associated with the full container are not opened until the key means is engaged therewith and retained by the closure member, there is no escape of ammonia fumes from either the empty of the full ammonia container during the interchange of the containers.

It is an object of the present invention to provide a cap assembly for an aqueous ammonia container to permit interchange of containers while preventing ammonia fumes from escaping from the containers to the atmosphere.

Another object of the invention is to provide a cap assembly for an ammonia container which eliminates the necessity of removing the shipping container cap when connecting the ammonia feed and drain tubes of the developer system of the copying machine to a container providing a fresh supply of ammonia.

Another object of the invention is to provide a cap assembly for an ammonia supply container including a closure member comprising a selectively actuable seal means movable between a closed position to prevent escape of ammonia fumes from the container when the container is to be replaced or is in a shipping position, and movable to an open position to permit flow of ammonia when the container is in operative working association with the machine.

Another object is to provide a key means associated with the ammonia feed and drain tubes releasably engagable with the seal means for selectively actuating the latter between a position in which the feed and the drain outlets are closed to prevent ammonia flow and a position in which the outlets are open to permit ammonia flow.

A feature of the invention is to provide a cap assembly for an ammonia container in which the closure member includes lock means for maintaining the seal means in the first position during storage and shipment of the container.

Other objects, features and advantages of the invention will appear hereinafter as the description proceeds.

IN THE DRAWING

DESCRIPTION OF THE PREFERRED EMBODIMENT

Figure 1:
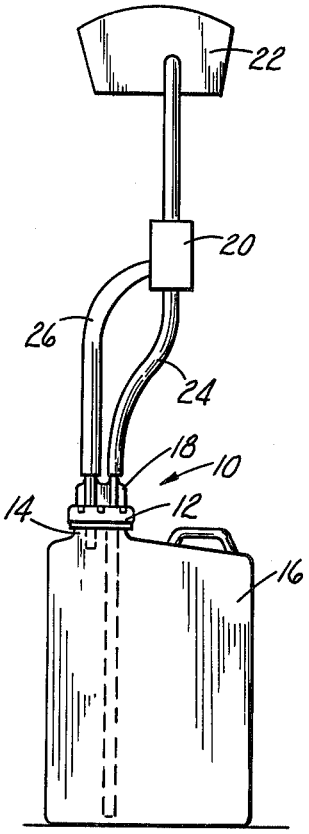
FIG. 1 is a schematic showing the environment of a cap assembly for use with an aqueous ammonia container for storing and supplying ammonia to a developer system of a diazo type copying machine in accordance with the present invention.
Figure 6:
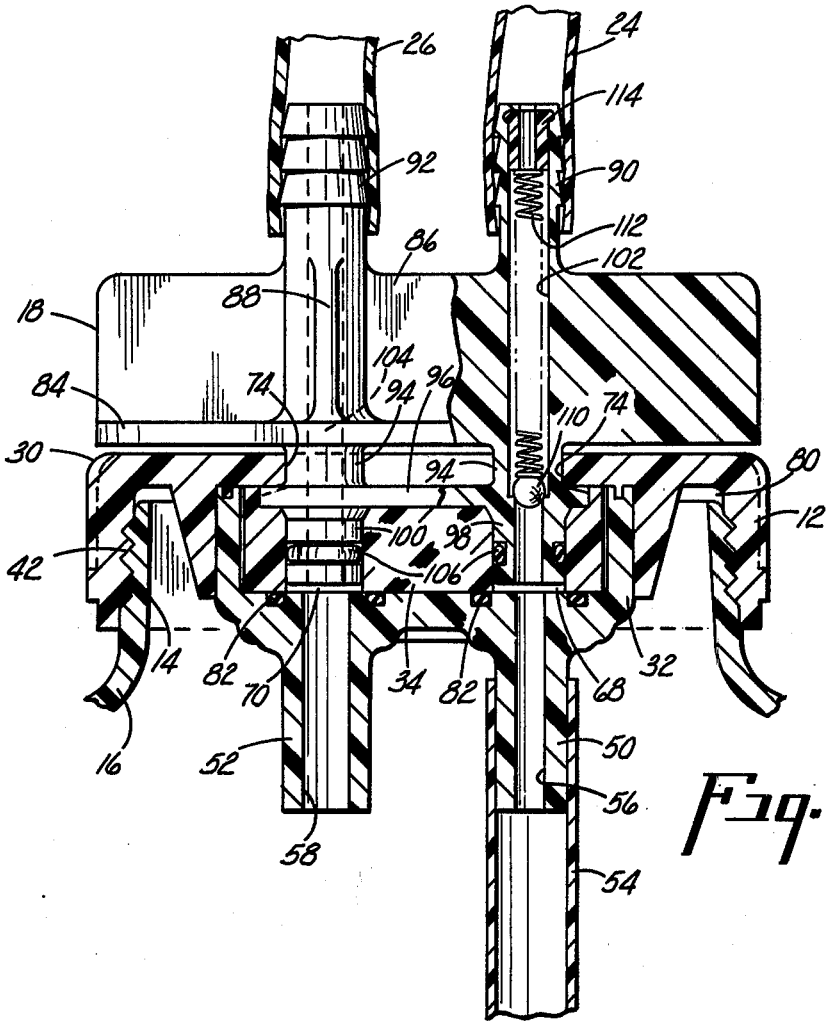
FIG. 6 is a front elevation of the closure member and the key means, partially in section, showing the seal means in the second position permitting ammonia flow.

With reference to FIGS. 1 and 6 there is shown a cap assembly indicated generally by the reference numeral 10. The cap assembly 10 comprises a closure member 12 releasably mounted on a flow opening or neck 14 of an ammonia container 16 and a key means 18 releasably engagable with the closure member 12. A pump 20 is provided for pumping ammonia from the container 16 to a developer system 22 via an ammonia feed tube 24, and any excess or ammonia overflow from the pump 20 is returned to the container 16 via an ammonia drain tube 26.

Figure 2:
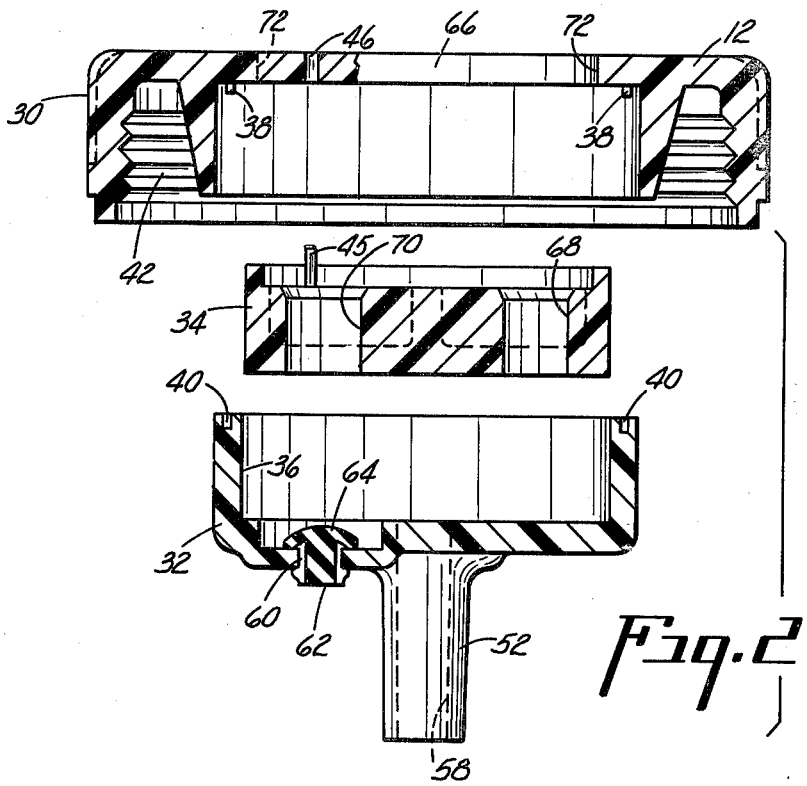
FIG. 2 is an exploded view, in section, of a closure member of the cap assembly.
Figure 3:
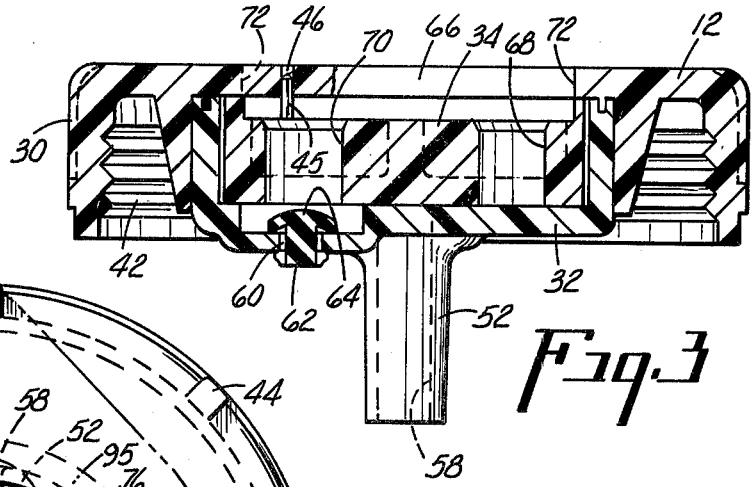
FIG. 3 is an assembly, in section, of the closure member of FIG. 2.

As shown best in FIGS. 2 and 3, the closure member 12 comprises an upper lid 30, a lower body 32 and a seal means 34 adapted to be rotatably supported in an opening 36 of the lower body 32. The upper lid 30 and the lower body 32 are preferably molded separately such that the seal means 34 may be positioned in the opening 36 prior to assembling and sonically welding the upper lid and the lower body to form a closure member 12 of integral construction for rotatably supporting the seal means 34 therewithin. To properly orient the upper lid 30 and the lower body 32 for a welding operation, the upper lid is provided with detents 38 which mate with corresponding notches 40 in the lower body when the upper lid and the lower body are in assembled relation. The upper lid 30, body 32, seal means 34 and the key means 18 are made of plastic or other suitable material resistant to attack by chemically reactive materials such as ammonia.

Figure 4:
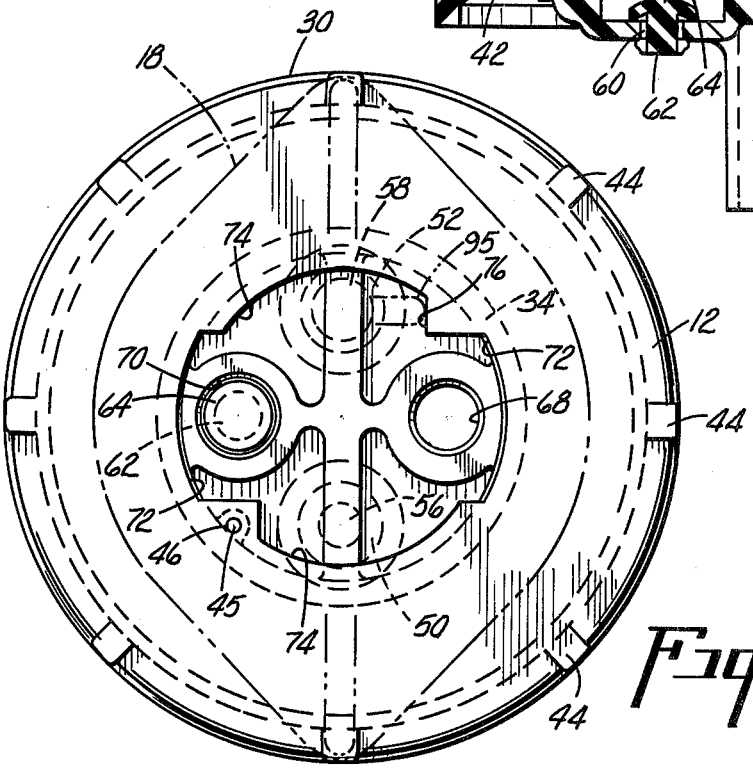
FIG. 4 is a plan view of the closure member showing a seal means thereof in a first position preventing ammonia flow.

The upper lid 30 is provided with threads 42 for releasably securing the closure member 12 on the neck 14 of the container 16, and the periphery of the upper lid 30 may be provided with nubbins 44, as shown in FIG. 4, to facilitate gripping the closure member when it is secured to and removed from the container 16. As shown in FIGS. 2, 3 and 4, the closure member 12 also provides a lock means in the form of a pin 45 on the seal means 34 adapted to coact with a hole 46 in the upper lid 30 to maintain the seal means against inadvertent rotation or movement out of the first position during storage or shipment of the container 16. The pin 45 is flexible so as to be deflected out of the hole 46 when the seal means 34 is rotated from the first to the second position to permit ammonia flow, and is flexed into the hole when the seal means is returned from the second to the first position.

The lower body 32 of the closure member 12 includes a depending connector 50 and a nozzle 52. The connector 50 supports one end of an inlet duct 54 extending to the bottom of the container 16 to permit emptying substantially all of the ammonia from the container as it is supplied to the developer system 22. The nozzle 52 terminates at a position near the top of the container 16 and provides for draining any excess of ammonia overflow from the pump 20 to the container via the drain tube 26. Also, the connector 50 is provided with a feed outlet 56 for passage of ammonia from the container 16 and the nozzle 52 is provided with a drain outlet 58 for passage of the ammonia to the container, as shown in FIGS. 4 and 6.

With reference to FIGS. 2 and 3, the body 32 is provided with a vent opening 60 for receiving therein a relief valve 62. The valve includes an enlarged head 64 overlying the opening 60, and a stem of circular cross section providing a slight clearance between the stem and the opening 60. Thus, in response to pressure build-up in the container 16, the head 64 is caused to flex and the air passes upwardly through the clearance around the stem and out from under the head 64. In this way, the valve 62 is effective to continually control the release of minute quantities of air from the container 16, as required, while maintaining the vent opening 60 in a normally closed or sealed condition.

As shown in FIGS. 2, 3, 4 and 6, the seal means 34 is disc shaped and includes a pair of apertures 68 and 70 adapted to be selectively positioned into and out of alignment with the outlets 56 and 58 respectively, in response to rotative movement of the seal means 34 within the opening 36 of the lower body 32 of the closure member 12. The top wall of the upper lid 30 is provided with a key-hole opening 66 including open arcuate ends 72, opposed flanges 74 overhanging the periphery of the seal means 34 and a stop surface 76 for limiting rotative movement of the key means 18 when the seal means is actuated from the first to the second position.

The seal means is rotatable between the first position as shown in FIG. 4 wherein the apertures 68 and 70 are out of alignment with the outlets 56 and 58 respectively, to maintain the outlets closed to prevent ammonia flow, and the second position as shown in FIG. 6 wherein the apertures 68 and 70 are aligned with the outlets 56 and 58 respectively, to maintain the outlets open to permit ammonia flow.

To prevent leakage or escape of ammonia fumes from the container 16, the closure member 12 is provided with a gasket 80 to seal the neck 14 of the container. Also, as shown in FIG. 6, an "O" ring seal 82 is positioned in a recess surrounding each of the outlets 56 and 58 to prevent passage of ammonia fumes from the container 16 through the apertures 68 and 70 to the atmosphere.

Figure 5:
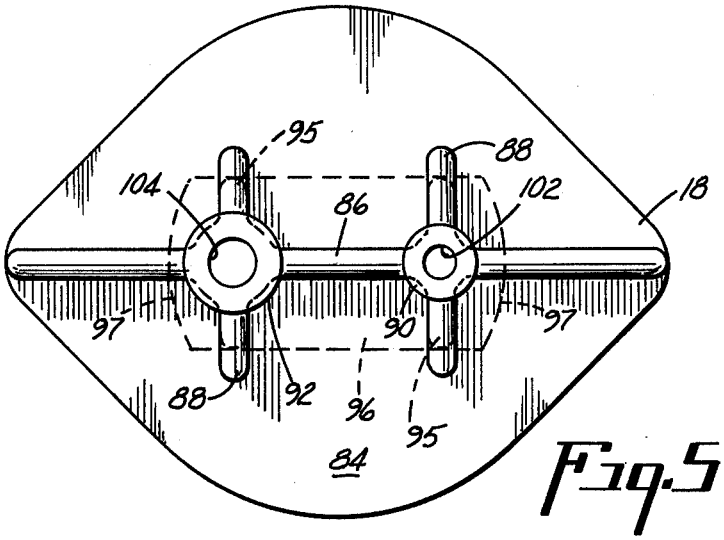
FIG. 5 is a plan view of a key means for actuating the seal means between the first and a second position.

The key means 18 is shown in FIGS. 5 and 6 and comprises a plate member 84 including upstanding ribs 86 and 88 providing a finger grip to permit the machine operator to manipulate the key means for actuating the seal means 34. A connector 90 is provided for mounting thereto a free end of the feed tube 24 and a connector 92 is provided for mounting a free end of the drain tube 26. The plate member 84 includes a pair of depending spacers 94 for supporting a retainer plate 96, and the retainer plate supports a pair of depending projections 98 and 100 adapted for releasable engagement with the apertures 68 and 70 respectively, of the seal means 34. The projections 98 and 100 are of different diameters, corresponding to the diameters of the apertures 68 and 70 respectively, to prevent incorrect insertion of the key means 18 and connection of the tubes 24 and 26 between the container 16 and the pump 20.

The connector 90, spacer 94 and the projection 98 are provided with a through opening 102, and the connector 92, spacer 90 and the projection 100 are provided with a through opening 104, to provide passages for ammonia feed and drain respectively, when the seal means 34 is in the second position as shown in FIG. 6.

Each of the projections 98 and 100 is also provided with an annular groove for retaining an "O" ring seal 106 to prevent escape of ammonia fumes from the container 16 through the apertures 68 and 70 to the atmosphere.

As shown in FIG. 6, the key means 18 is also provided with a check valve comprising a ball 110 normally maintaining closed the opening 102, when ammonia is not being fed from the container 16, under the influence of a spring 112. The spring 112 is positioned in the opening 102, above the projection 98, and extends between the ball 110 and a retainer plug 114 provided at the open end of the connector 90. When the pump 20 is operating to supply ammonia from the container 16 to the developer system 22, the force of the pump overcomes the resistance of the spring 112, thereby causing the ball 110 to lift and permit passage of ammonia through the opening 102. This arrangement avoids dripping of ammonia or escape of ammonia fumes from the feed tube 24 when the key means 18 is removed from the seal means 34 of the closure member 12.

The key means 18 is releasably engageable with the seal means 34 for selectively actuating the seal means between the first position in which the outlets 56 and 58 are closed against ammonia flow, and the second position in which the outlets are open to permit ammonia flow. The key means 18 is inserted in the key-hole opening 66 with ends 97 of the retainer plate 96 aligned with the open ends 72 of the key-hole opening, the projections 98 and 100 are inserted into the apertures 68 and 70 respectively, of the seal means 34 and the key means is rotated in a clockwise direction to the position shown in phantom in FIG. 4. In so doing, the ends 97 ride under the flanges 74 which effectively hold the retainer plate 96 on the upper lid 30 of the closure member 12 as shown in FIG. 6. The key means 18 is arrested in the FIG. 4 position by a rib 95, extending from each of the spacers 94 as shown in FIG. 5, abutting the stop surface 76 associated with the key-hole opening 66. Thus, positive alignment is assured of the apertures 68 and 70 with the outlets 56 and 58 respectively, to allow ammonia flow.

In the operation of the cap assembly 10, the container 16 of ammonia is stored and shipped with the closure member 12 secured on the neck 14 and the seal means 34 in the first position, as shown in FIGS. 3 and 4, where it is retained against inadvertent movement by the pin 45 and the hole 46 defining the lock means. To connect the container 16 to the developer system 22, the machine operator merely inserts the key means 18 through the key-hole opening 66, into engagement with the seal means 34 and rotates the key means to the position shown in phantom in FIG. 4, and the seal means to the second position, where it is arrested agaist further rotation by the rib 95 and the stop surface 76. During this rotation of the seal means 34, the pin 45 snaps out of the hole 46 and the ends 97 of the retainer plate 96 are moved under the flanges 74 to hold the key means in an operative position with all of the ammonia flow passages in an open condition.

When the ammonia supply in the container 16 is exhausted, the machine operator rotates the key means 18 in the opposite direction thereby moving the retainer plate 96 out from under the flanges 74 and actuating the the seal means 34 to the first position, shown in FIGS. 3 and 4, where all of the passages are closed to ammonia flow. In this position the pin 45 snaps into the hole 46 to again retain the seal means 34 in the first position and the key means 18 is lifted up and out of engagement with the seal means. The check valve associated with the key means 18 prevents any escape of ammonia from the feed tube 24 during removal of the key means from the closure member 12.

Thereafter, a container 16 providing a fresh supply of ammonia may be connected to the machine by actuating the seal means as described supra, and there is no leakage of ammonia fumes from the containers to the atmosphere during the interchange of containers.

From the foregoing, it will be appreciated that the present invention provides a cap assembly for an ammonia container for use with a diazo type copying machine which is simple in construction and use, and reliable in operation to prevent ammonia fumes from escaping from the container during interchange of an empty container with a container providing a fresh supply of ammonia. Because the closure member is releasably mounted on the container and may be used any number of times in the course of refilling the ammonia container, and since only a single key means is required for each machine installation, the cap assembly provides an inexpensive arrangement for effectively sealing the container against exposure of the ammonia to the atmosphere while permitting quick and easy actuation of the seal means in the opening and closing of the ammonia flow passages of the cap assembly.

What is claimed is:

1. A cap assembly for use with a container for storing and supplying volatile material, comprising:

a closure member of integral construction adapted to be releasable mounted on a dispensing opening of the container and comprising an upper lid, a lower body and a seal means provided with aperture means;

outlet means on the lower body for passage of said material from the container;

vent means provided in the lower body for venting the container in response to pressure build-up of the material in the container;

said seal means rotatably supported by the lower body for actuation between a first position for closing the outlet means to prevent passage of said material from the container and a second position for opening the outlet means to permit passage of said material;

lock means on the upper lid and the seal means for maintaining the seal means in the first position during storage and shipment of the container; and key means releasably engageable with the upper lid and including projection means releasably engagable with the aperture means for selectively actuating the seal means between the first position in which the aperture means is out of alignment with the outlet means and the second position in which the aperture means is in alignment with the outlet means.

2. A cap assembly as set forth in claim 1 in which the outlet means further includes a drain outlet on the lower body for passage of said material to the container.

3. A cap assembly as set forth in claim 1 in which the key means includes opening means positionable into alignment with the outlet means in response to actuation of the seal means to the second position and positionable out of alignment with the outlet means in response to actuation of the seal means to the first position; and means on the upper lid for retaining the key means in engagement with the seal means when the seal means is actuated to the second position and for releasing the key means from the seal means when the seal means is actuated to the first position.

4. A cap assembly as set forth in claim 3 in which the key means includes check valve means coacting with the opening means to prevent leakage of said material from the key means when the key means is released from the seal means.

5. A cap assembly as set forth in claim 1 in which the lock means comprises a pin on the seal means coacting with a hole in the upper lid.

6. A cap assembly as set forth in claim 1 further comprising means on the upper lid for retaining the key means in engagement with the seal means when the seal means is in the second position and for releasing the key means from the seal means when the seal means is in the first position.

whereby the outlet means is closed and the key means removed from the seal means of an empty material container and engaged with the seal means of a fresh material container for actuating the seal means to open the outlet means while preventing exposure of said material in the containers to the atmosphere during interchange of the containers.

7. A cap assembly for use with a container for storing and supplying a volatile material, comprising:

a closure member of integral construction adapted to be releasably mounted on a dispensing opening of the container and comprising an upper lid, a lower body and a seal means provided with aperture means;

a feed outlet on the lower body for passage of said material from the container;

a drain outlet on the lower body for passage of said material to the container;

vent means provided in the lower body for venting the container in response to pressure build-up of the material in the container;

said seal means rotatably supported by the lower body for actuation between a first and a second position for positioning the aperture means into alignment with the feed and the drain outlets in response to actuation of the seal means to the second position, and positioning the aperture means out of alignment with the feed and the drain outlets in response to actuation of the seal means to the first position;

lock means on the upper lid and the seal means for maintaining the seal means in the first position during storage and shipment of the container; and key means including opening means in alignment with the aperture means, said key means being releasably engagable with the upper lid and including projection means releasably engagable with the aperture means for selectively actuating the seal means between the first and second positions.

8. A cap assembly as set forth in claim 7 further comprising means on the closure member for retaining the key means in engagement with the seal means when the seal means is in the second position and for releasing the key means from the seal means when the seal means is in the first position.

9. A method of replacing an empty volatile material container with a container providing a fresh supply of said material for storing and supplying said material and preventing exposure of said material in the containers to the atmosphere during the interchange of the containers, comprising the steps of:

providing the container with a closure member comprising an upper lid, a lower body and a seal means provided with aperture means and adapted to be releasably mounted on a dispensing opening of the container;

supplying said material from the container through outlet means in the lower body;

providing the lower body with vent means to prevent pressure build-up of the material in the container;

actuating the seal means between a first position for closing the outlet means to prevent passage of said material from the container and a second position for opening the outlet means to permit passage of said material;

locking the seal means against movement from the first to the second position during storage and shipment of the container;

mounting a key means for releasable engagement with the upper lid and providing the key means with projection means releasably engageable with the aperture means for selectively actuating the seal means between the first position in which the aperture means is out of alignment with the outlet means and the second position in which the aperture means is in alignment with the outlet means; and retaining the key means on the upper lid when the seal means is actuated to the second position and releasing the key means from the upper lid when the seal means is actuated to the first position, thereby permitting interchange of containers only when the outlet means is closed.

* * * * *